US009776749B2

(12) United States Patent
Moore et al.

(10) Patent No.: US 9,776,749 B2
(45) Date of Patent: Oct. 3, 2017

(54) METHOD OF PACKAGING PRODUCT UNITS AND A PACKAGE OF PRODUCT UNITS

(75) Inventors: Gregory D. Moore, Madison, GA (US); Tracey L. Meckley, Canton, GA (US); Michael S. Dwyer, Stockbridge, GA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 71 days.

(21) Appl. No.: 13/279,758

(22) Filed: Oct. 24, 2011
(Under 37 CFR 1.47)

(65) Prior Publication Data

US 2012/0234712 A1 Sep. 20, 2012

Related U.S. Application Data

(60) Provisional application No. 61/410,135, filed on Nov. 4, 2010.

(51) Int. Cl.
*B65D 85/00* (2006.01)
*B65B 13/02* (2006.01)
(Continued)

(52) U.S. Cl.
CPC ..... *B65B 13/02* (2013.01); *B65B 27/125* (2013.01); *B65D 71/02* (2013.01); *B65D 71/08* (2013.01); *B65D 71/10* (2013.01); *B65D 85/16* (2013.01)

(58) Field of Classification Search
CPC ..... B65D 85/672; B65D 71/00; B65D 71/08; B65D 71/02; B65D 71/10; B65D 85/16; B65D 85/00; B65B 13/02; B65B 27/125
(Continued)

(56) References Cited

U.S. PATENT DOCUMENTS 2,062,539 A * 12/1936 Vogt ..... 426/108
3,217,874 A * 11/1965 Potter ..... 206/432
(Continued)

FOREIGN PATENT DOCUMENTS

CN 2491377 Y 5/2002
EP 0704384 A2 4/1996
(Continued)

OTHER PUBLICATIONS

International Search Report and Written Opinion of the International Searching Authority that issued for PCT/US2011/058507 dated May 7, 2012.
(Continued)

*Primary Examiner* — J. Gregory Pickett
*Assistant Examiner* — Rafael Ortiz
(74) *Attorney, Agent, or Firm* — Laura L. Bozek

(57) ABSTRACT

A package of product units includes an entirely wrapped first product unit including a first product unit completely enveloped in a cover. An entirely wrapped second product unit (i) includes a second product unit completely enveloped in a cover and (ii) is disposed adjacent to the wrapped first product unit. A band disposed around the wrapped first product unit and the wrapped second product unit creates a secured product arrangement A wrapper completely envelopes the band, the wrapped first product unit, and the wrapped second product unit of the secured product arrangement to create a wrapped secured product arrangement, such that the wrapper directly contacts the band The wrapped secured product arrangement consists essentially of wrapped product units, the band, and the wrapper. The cover of the first product unit, the cover of the second product unit, the band, and the wrapper each comprises a plastic material.

37 Claims, 13 Drawing Sheets

(51) Int. Cl.

| | |
|---|---|
| ***B65B 27/12*** | (2006.01) |
| ***B65D 71/02*** | (2006.01) |
| ***B65D 71/08*** | (2006.01) |
| ***B65D 71/10*** | (2006.01) |
| ***B65D 85/16*** | (2006.01) |

(58) Field of Classification Search

USPC ..... 206/391, 770, 143, 150, 397, 432, 497, 206/812, 389, 83.5, 394; 53/147, 543, 53/540

See application file for complete search history.

(56) References Cited

U.S. PATENT DOCUMENTS

| | | | | |
|---|---|---|---|---|
| 3,338,404 | A | 8/1967 | Becker et al. | |
| 3,460,671 | A | 8/1969 | Harm | |
| 4,077,516 | A | 3/1978 | Duerr | |
| 4,120,716 | A | 10/1978 | Bonet | |
| 4,289,236 | A * | 9/1981 | Ganz et al. | 206/432 |
| 4,444,311 | A | 4/1984 | Rias | |
| 4,535,587 | A * | 8/1985 | Rias | B65D 71/0088 53/436 |
| 4,595,093 | A | 6/1986 | Eckstein | |
| 4,628,666 | A * | 12/1986 | Lems | 53/398 |
| 4,828,110 | A * | 5/1989 | Lems | 206/427 |
| 4,886,167 | A * | 12/1989 | Dearwester | 206/389 |
| 4,893,712 | A * | 1/1990 | Allen et al. | 206/150 |
| 4,911,290 | A * | 3/1990 | Karabedian et al. | 206/151 |
| 4,971,197 | A | 11/1990 | Worley | |
| 5,027,582 | A | 7/1991 | Dearwester | |
| 5,067,612 | A | 11/1991 | Tsuchiya et al. | |
| 5,160,030 | A * | 11/1992 | Binsfeld | 206/497 |
| 5,570,787 | A * | 11/1996 | Danovaro et al. | 206/428 |
| 5,685,428 | A * | 11/1997 | Herbers et al. | 206/391 |
| 5,887,717 | A * | 3/1999 | Anderson et al. | 206/460 |
| 5,934,470 | A | 8/1999 | Bauer et al. | |
| 5,976,113 | A | 11/1999 | Morigi et al. | |
| 6,021,890 | A * | 2/2000 | Focke et al. | 206/83.5 |
| 6,105,776 | A * | 8/2000 | Meilhon | 206/497 |
| 6,213,293 | B1 | 4/2001 | Marco | |
| 6,588,594 | B2 | 7/2003 | Andersen et al. | |
| 6,770,339 | B2 | 8/2004 | Teague, III et al. | |
| 6,880,313 | B1 | 4/2005 | Gessford et al. | |
| 7,237,671 | B2 * | 7/2007 | Chambers et al. | 206/150 |
| 7,310,922 | B2 | 12/2007 | Carrigan et al. | |
| 7,311,199 | B2 * | 12/2007 | Vantilt | 206/321 |
| 7,364,520 | B2 | 4/2008 | Chauvin et al. | |
| 7,621,397 | B2 | 11/2009 | Boudrie et al. | |
| 7,775,349 | B2 * | 8/2010 | Walker | 206/162 |
| 7,850,003 | B2 | 12/2010 | Hartness et al. | |
| 7,861,490 | B2 | 1/2011 | Hartness et al. | |
| 7,878,328 | B2 * | 2/2011 | Dubosq et al. | 206/432 |
| 8,066,186 | B2 | 11/2011 | Kidwell | |
| 8,231,001 | B2 | 7/2012 | Boon et al. | |
| 8,256,616 | B2 | 9/2012 | Eilert | |
| 8,500,022 | B2 | 8/2013 | Kidwell et al. | |
| 9,216,832 | B2 | 12/2015 | Cerf | |
| 9,242,775 | B2 | 1/2016 | Knobloch et al. | |
| 2002/0162766 | A1 | 11/2002 | Saso et al. | |
| 2003/0155266 | A1 * | 8/2003 | Andersen et al. | 206/497 |
| 2004/0200752 | A1 | 10/2004 | Poli | |
| 2006/0053754 | A1 | 3/2006 | Carrigan et al. | |
| 2006/0157367 | A1 * | 7/2006 | Carrigan | B65B 5/105 206/425 |
| 2007/0084741 | A1 * | 4/2007 | Dall'Omo | 206/391 |
| 2007/0215503 | A1 | 9/2007 | Hartness et al. | |
| 2007/0215504 | A1 | 9/2007 | Walker | |
| 2007/0215505 | A1 | 9/2007 | Walker | |
| 2007/0215506 | A1 | 9/2007 | Hartness et al. | |
| 2008/0078685 | A1 * | 4/2008 | Patterson et al. | 206/391 |
| 2008/0202964 | A1 * | 8/2008 | Knobloch et al. | 206/394 |
| 2009/0120816 | A1 | 5/2009 | Ruman et al. | |
| 2009/0120825 | A1 | 5/2009 | Ruman et al. | |
| 2009/0145792 | A1 | 6/2009 | Lewis et al. | |
| 2009/0197231 | A1 | 8/2009 | Sosalla | |
| 2009/0301921 | A1 | 12/2009 | Kidwell | |
| 2011/0056175 | A1 | 3/2011 | Harness et al. | |
| 2011/0088354 | A1 | 4/2011 | Murgia Mendizabal et al. | |
| 2011/0099949 | A1 | 5/2011 | Hartness et al. | |
| 2011/0147258 | A1 | 6/2011 | Hartness et al. | |
| 2011/0266183 | A1 | 11/2011 | Boon et al. | |
| 2011/0284558 | A1 | 11/2011 | Cerf | |
| 2012/0043246 | A1 | 2/2012 | Kidwell et al. | |
| 2013/0067864 | A1 | 3/2013 | Dwyer | |
| 2013/0206631 | A1 | 8/2013 | Bazbaz | |
| 2013/0220860 | A1 | 8/2013 | Bacon et al. | |

FOREIGN PATENT DOCUMENTS

| | | | |
|---|---|---|---|
| EP | 0803446 | A2 | 10/1997 |
| EP | 1405802 | A1 | 4/2004 |
| EP | 1777170 | A1 | 4/2007 |
| EP | 2082971 | A1 | 7/2009 |
| JP | S53-97587 | A | 8/1978 |
| JP | S56-500804 | A | 6/1981 |
| JP | H08-508455 | A | 9/1996 |
| JP | 2001-240121 | A | 9/2001 |
| JP | 2004-231438 | A | 8/2004 |
| JP | 2005-132376 | A | 5/2005 |
| WO | 99/38784 | A1 | 8/1999 |
| WO | 2006050748 | A1 | 5/2006 |
| WO | 2009/013164 | A1 | 1/2009 |
| WO | 2009013165 | A1 | 1/2009 |
| WO | 2013/043481 | A1 | 3/2013 |

OTHER PUBLICATIONS

SCA Hygiene Products, New Tork Carry Pack Saves Time and Money, Jan. 1, 2010, retrieved from http://www.tork.co.uk/Pages/News/News.aspx?id=182931.

Correspondence dated Mar. 26, 2014, regarding Mexican Patent Application No. MX/a/2013/003997.

Communication, including Supplementary European Search Report, dated May 27, 2014, in corresponding European Patent Application No. 11838599.6-1708 /2635505 PCT/US2011058507.

Communication pursuant to Article 94(3) EPC dated Feb. 16, 2015, issued in counterpart European Patent Application No. 11 838 599.6-1708.

Chinese Official Action dated Aug. 29, 2014, issued in counterpart Chinese Patent Application No. 201180053105.8, with an English translation.

Japanese Office Action dated Aug. 4, 2015, issued in corresponding Japanese Patent Application No. 2013-537737, with an English translation.

Chinese Official Action dated Sep. 6, 2015, in counterpart Chinese Patent Application No. 201180053105.8, with an English translation.

Japanese Notice of Allowance dated Mar. 1, 2016, issued in corresponding Japanese Patent Application No. 2013-537737, with an English translation.

Article 94(3) EPC Communication dated Mar. 30, 2016, issued in corresponding European Patent Application No. 11 838 599.6-1708.

Mexican Official Action dated Jul. 11, 2016, issued in corresponding Mexican Patent Application No. MX/a/2013/003997, with an English translation.

Mexican Official Action dated Jan. 14, 2016, issued in corresponding Mexican Patent Application No. MX/a/2013/003997, with English translation.

Canadian Communication dated Nov. 14, 2016, issued in corresponding Canadian Patent Application No. 2,816,759.

Mexican Official Action dated Nov. 30, 2016, issued in corresponding Mexican Patent Application No. MX/a/2013/003997, with an English translation.

English translation of Japanese Notice of Allowance dated Jan. 10, 2017, issued in corresponding Japanese Patent Application No. 2016-091687.

(56) References Cited

OTHER PUBLICATIONS

Article 94(3) EPC Communication dated Nov. 8, 2016, issued in corresponding European Patent Application No. 11 838 599.6-708.

* cited by examiner

METHOD OF PACKAGING PRODUCT UNITS AND A PACKAGE OF PRODUCT UNITS

CLAIM FOR PRIORITY

This non-provisional application is based upon U.S. Provisional Patent Application No. 61/410,135, of the same title, filed Nov. 4, 2010. The priority of U.S. Provisional Patent Application No. 61/410,135 is hereby claimed and the disclosure thereof is incorporated into this application by reference.

BACKGROUND OF THE INVENTION

The subject matter disclosed herein relates to packaging goods, such as consumer goods. Previous packaging methods included using corrugated boxes or containers to package consumer goods. For example, a plurality of consumer goods may be packaged in a corrugated container fabricated from corrugated sheet products for shipping to a retailer and/or storage in inventory. The container consumes valuable material, energy, and personnel resources. In use, the consumer goods are placed on shelves, and the shipping container is discarded or recycled.

A packing method and apparatus that reduces the use of corrugated containers is desired.

BRIEF DESCRIPTION OF THE INVENTION

In one aspect of the present invention, a method for packaging a product includes arranging a first product adjacent to a second product to define an arrangement, forming a band around the first product and the second product, and forming a protective wrapper, the protective wrapper at least partially enveloping the band, the first product, and the second product.

In another aspect of the present invention, a packaging system includes a first product and a second product, a band disposed around the first product and the second product, the first product disposed adjacent to the second product, and a shrinkable protective wrapper, the protective wrapper at least partially enveloping the band, the first product, and the second product.

In yet another aspect of the present invention, a sheet product and packaging arrangement includes a first group of rolled sheet products, the first group including at least two rolls of sheet products, a second group of rolled sheet products, the second group including at least two rolls of sheet products, a band disposed around the first group and the second group, and a protective wrapper, the protective wrapper at least partially enveloping the band, the first group, and the second group.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example, with reference to the drawings.

DETAILED DESCRIPTION OF THE INVENTION

Previous packaging methods included disposing a plurality of products in a shipping container such as, for example, a corrugated box or shipping carton. The shipping container consumed material and energy resources. The exemplary methods and apparatus described below include embodiments that allow a plurality of products to be shipped and stored without the use of a shipping carton.

The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general sheet products are thin in comparison to their length and breadth and exhibit a relatively flat planar configuration and are flexible to permit folding, rolling, stacking, and the like. The sheet product may have perforations extending in lines across their width to separate individual sheets and facilitate separation or tearing of individual sheets from a roll or folded arrangement at discrete intervals. Individual sheets may be sized as desired to accommodate the many uses of the sheet products. For example, perforation lines may be formed every thirteen inches, or other defined interval, to define a universally sized sheet. Multiple perforation lines may be provided to allow the user to select the size of sheet depending on the particular need.

Figure 1:
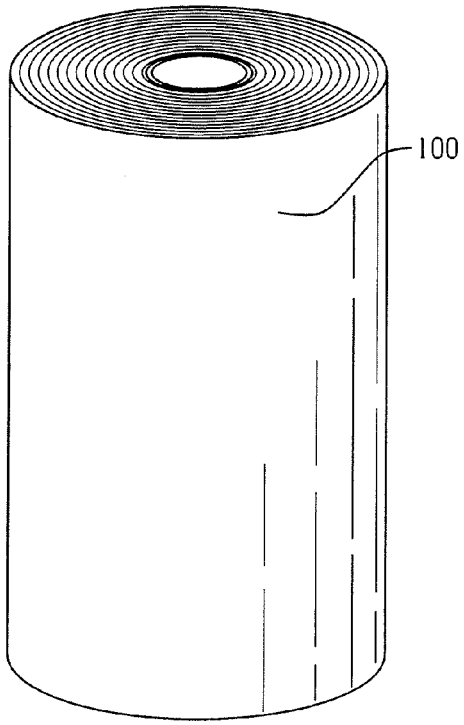
FIG. 1 illustrates an example of a roll of sheet product.
Figure 2:
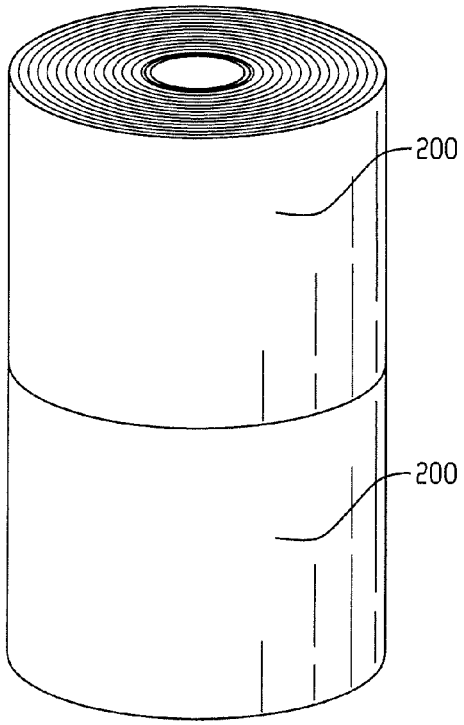
FIG. 2 illustrates another example of rolls of sheet products.

FIG. 1 illustrates an example of a roll of sheet product (roll) 100. The roll of sheet product 100 may include a cylindrical core in the center of the roll 100. Alternate embodiments, however, may not necessarily include a cylindrical core. FIG. 2 illustrates another example of rolls of sheet products 200. The rolls 200 have a shorter cylindrical height than the roll 100 and are arranged so as to be stacked on-end.

Figure 3:
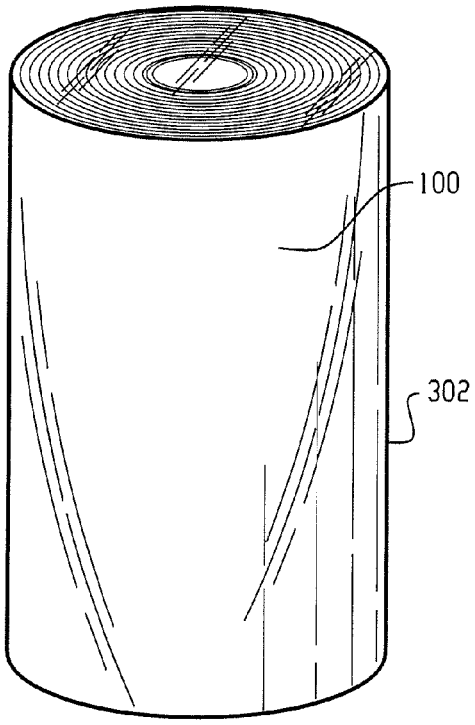
FIG. 3 illustrates an example of the roll that has been wrapped in a protective cover.
Figure 4:
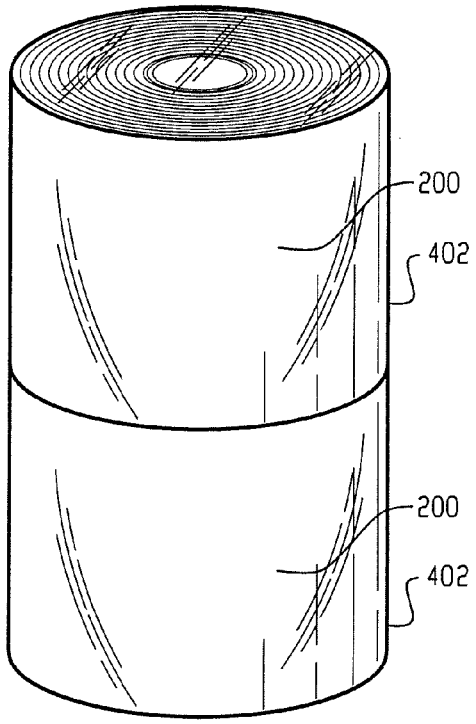
FIG. 4 illustrates an example of the rolls that are individually wrapped in a protective cover.

FIG. 3 illustrates an example of the roll 100 (of FIG. 1) that has been wrapped in a protective cover 302. The protective cover 302 envelopes the roll 100. The protective cover 302 may be formed from any suitable material such as, for example, a plastic or a fibrous sheet product. The protective cover 302 may be transparent, translucent, or opaque, and may include graphics or text printed on the protective cover 302. FIG. 4 illustrates an example of the rolls 200 (of FIG. 2) that are individually wrapped in a protective cover 402. The protective cover 402 is similar to the protective cover 302 (of FIG. 3) described above.

Figure 5:
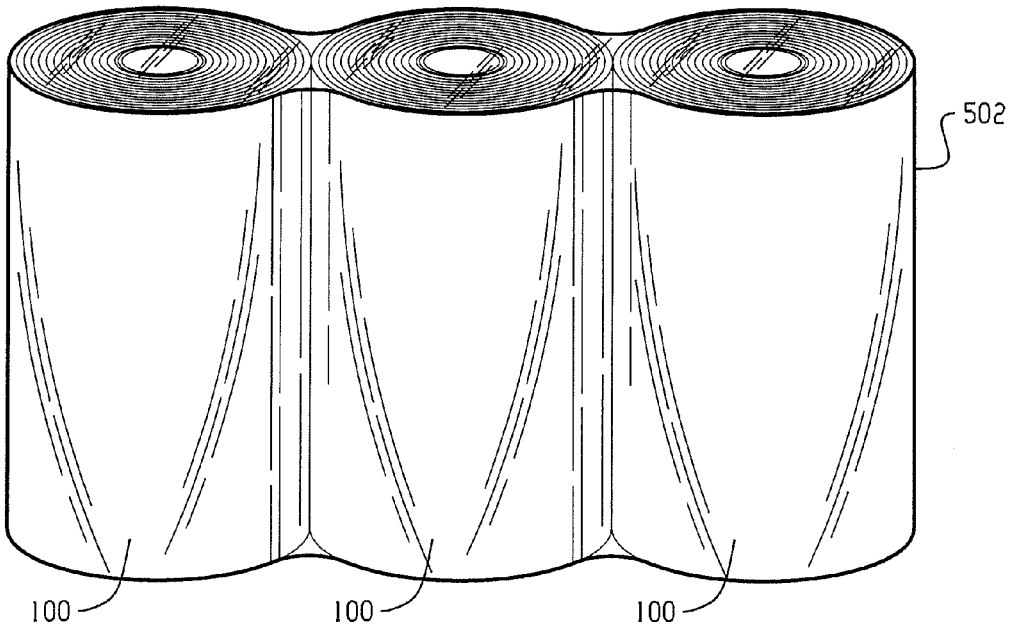
FIG. 5 illustrates an arrangement of rolls.

FIG. 5 illustrates an arrangement of the rolls 100 (of FIG. 1). In this regard, three rolls 100 are arranged in-line and are packaged in a protective cover 502. In the illustrated embodiment, the protected cover 502 may be fabricated from, for example, a plastic or fibrous sheet product material that may be transparent, translucent, or opaque. In an alternate embodiment, the wrapped arrangement of the roll 100 that includes the protective cover 302 (of FIG. 3) may be incorporated into the illustrated embodiment of FIG. 5 such that each roll 100 may be individually wrapped in a protective cover 302. The wrapped rolls 100 may then be arranged in-line, and subsequently wrapped in the protective cover 502.

Figure 6:
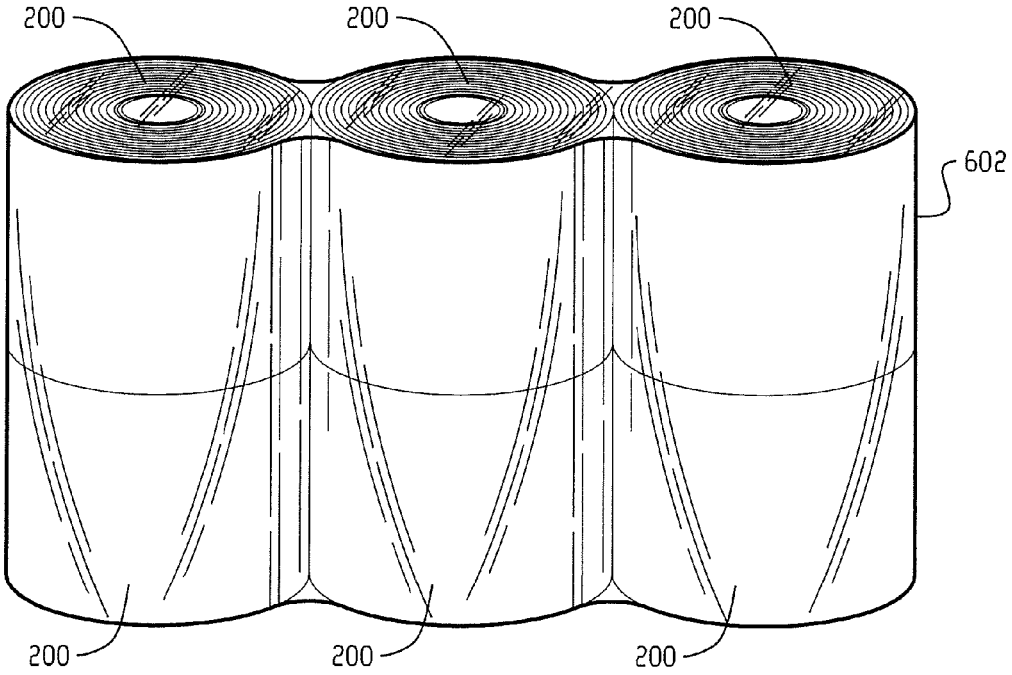
FIG. 6 illustrates an alternate arrangement of the rolls.

FIG. 6 illustrates an arrangement of the rolls 200 (of FIG. 2) that are stacked on-end and arranged in-line in a similar manner as the rolls 100 of FIG. 5. The illustrated arrangement of the rolls 200 is wrapped in a protective cover 602 that is similar to the protective cover 502 (of FIG. 5). In an alternate exemplary embodiment, the rolls 200 may be individually wrapped in the protective cover 402 (of FIG. 4) prior to wrapping the rolls 200 in the protective cover 602.

Figure 7:
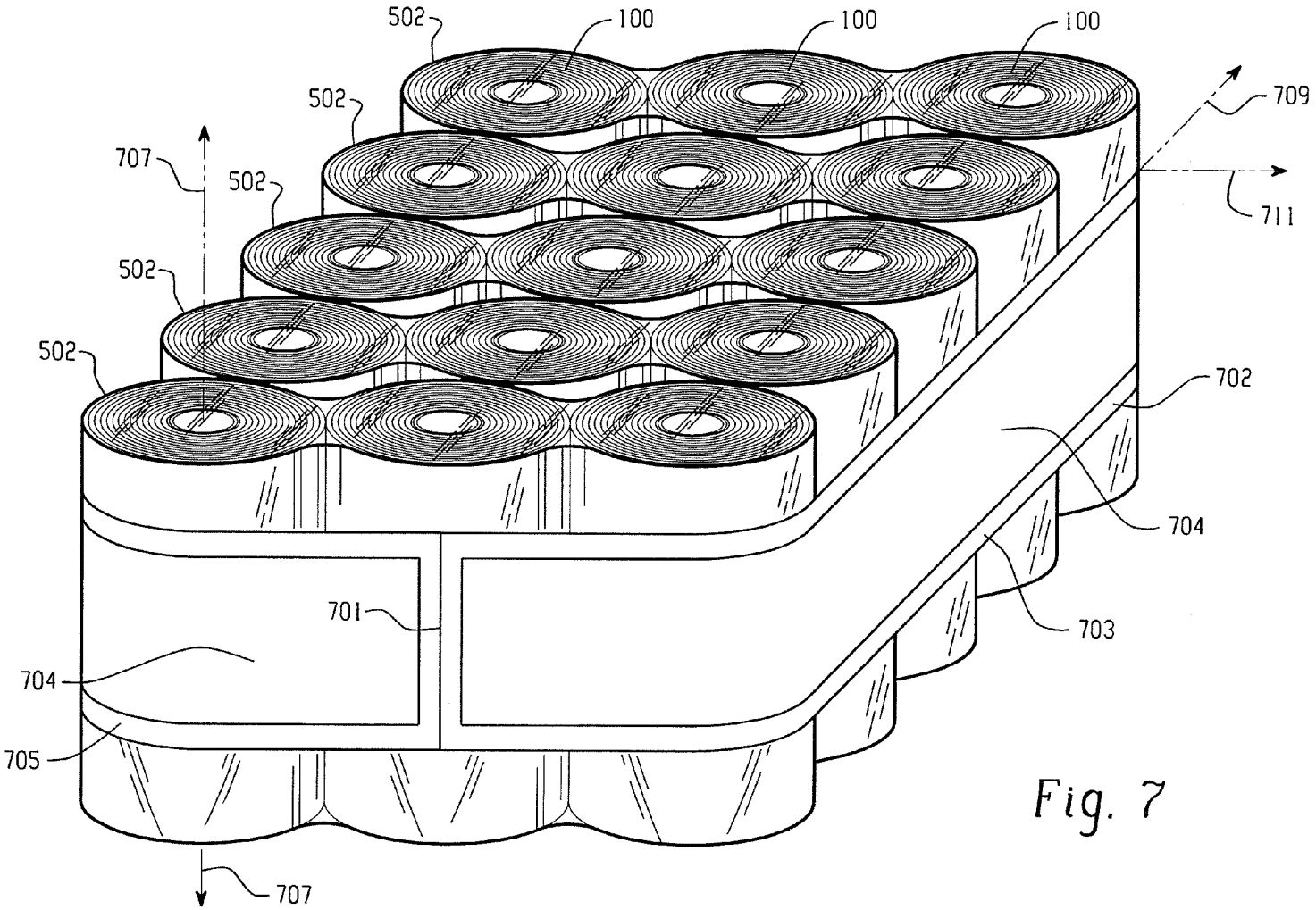
FIG. 7 illustrates an exemplary embodiment of an arrangement of rolls that have been secured by a band.

FIG. 7 illustrates an exemplary embodiment of an arrangement of rolls 100 that have been secured by a band 702. In the illustrated embodiment, the rolls 100 have been arranged and wrapped in a similar manner as the rolls 100 of FIG. 5 described above. Thus, the rolls 100 have been arranged in-line and wrapped in groups of three rolls. Five of the groups of rolls 100 are arranged and secured by the band 702. The band 702 may be formed from, for example, a plastic material that may have elastic properties. The band 702 exerts a compressive force on the arrangement of rolls 100, securing the rolls 100 in the illustrated arrangement. In the illustrated embodiment, an example of a longitudinal axis of the rolls 100 is shown by the line 707, and edges of the band 702 define a plane illustrated by the lines 709 and 711. The band 702 is arranged circumferentially about the rolls 100, such that the plane defined by the lines 709 and 711 is arranged substantially orthogonal to a longitudinal axis of the roll 100 (shown by the line 707). In the illustrated embodiment, the band 702 is formed from two rectangular strips 703 and 705 of material that are connected together at opposing seams 701 (only one seam shown in FIG. 7, the other seam being hidden from view on the opposite side of the arrangement of rolls), using a connecting process such as, for example, a plastic heating, welding, or bonding process. In alternate embodiments, the band 702 may be formed from a single strip having opposing ends connected together with a single seam 701. The material that forms the band 702 may be printed with graphic or textual markings in, for example, the regions 704, prior to forming the band 702. The process used to connect the strips 703 and 705 of material is operative to form the seams 701 without appreciably deforming the band 702 (except, in some embodiments, in the regions proximate to the seams 701). Thus, the connecting process does not deform the regions 704 that may include graphical, opaque regions, or textual markings in the regions 704. The process may also index the orientation of the strips 703 and 705, such that the arrangement of the regions 704 remains uniform as subsequent bands 702 are formed in mass production. Though the illustrated embodiment includes five groups of three rolls 100, alternate arrangements may include, for example, any number of groups of three rolls 100 or any number of groups of rolls 100 having any number of rolls 100 per group. The dimensions and shape of the regions 704 of illustrated embodiment are shown for illustrative purposes. The regions 704 may be any shape or size including covering any or all areas of the band 702.

Figure 8A:
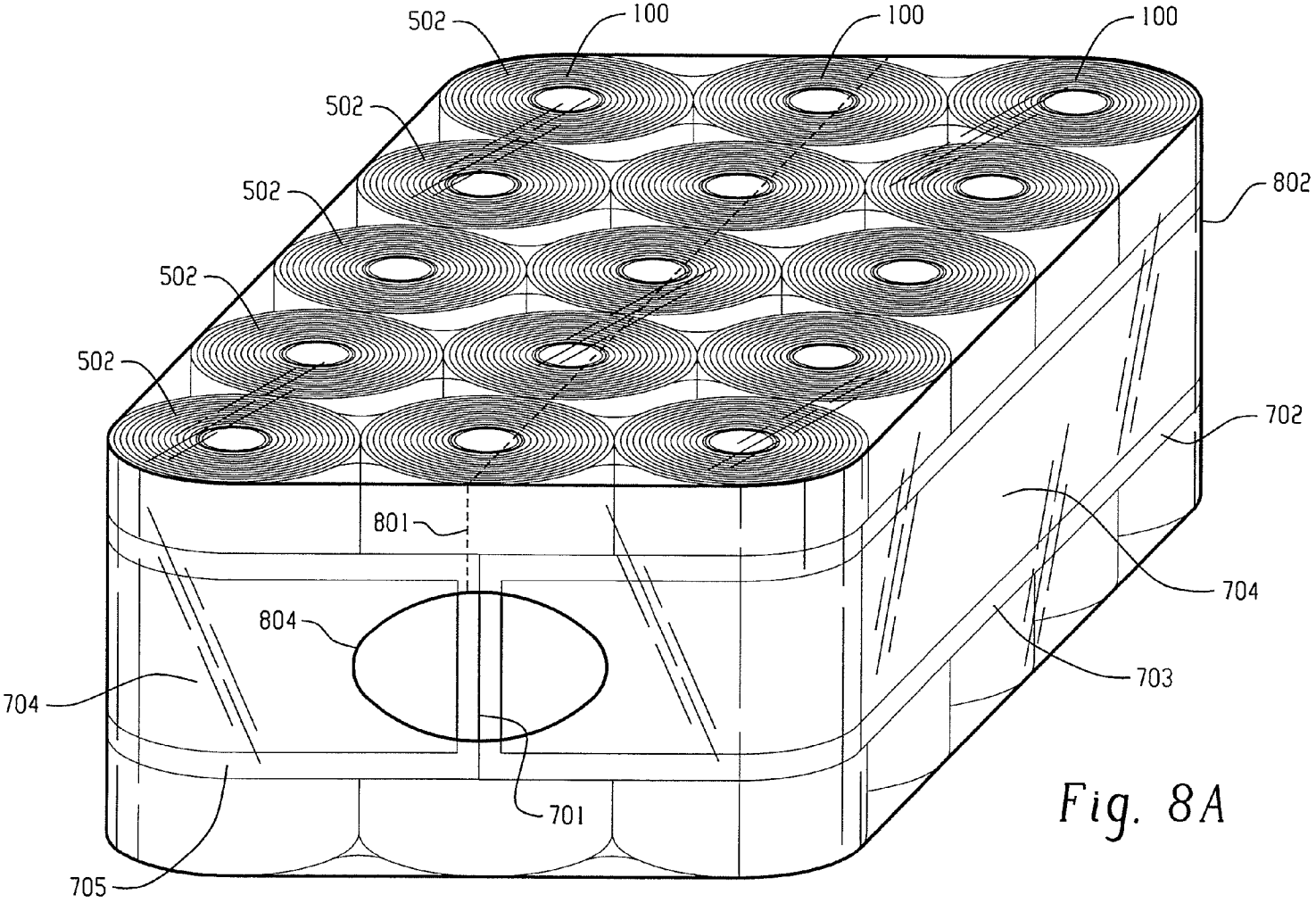
FIG. 8A illustrates an exemplary embodiment of the arrangement of the rolls shown in FIG. 7 that has been wrapped in a wrapper.

FIG. 8A illustrates an exemplary embodiment of the arrangement of rolls 100 (shown in FIG. 7) above that has been wrapped in a wrapper 802. The wrapper 802 envelopes the rolls 100 and the band 702. The wrapper 802 is formed from a plastic material that may be heated to shrink the wrapper 802 around the rolls 100 and the band 702. The wrapper 702 may be formed from, for example, a tubular shaped plastic material that is arranged about the rolls 100 and the band 702. The wrapper 802 may be transparent or translucent and may, or may not include graphic or textual markings printed on the wrapper 802. If a heating process is used to shrink the wrapper 802, the heating process shrinks the wrapper 802, without appreciably shrinking or deforming the band 702. Thus, the graphical and textual markings on the band 702 remain formed and intact, and may be legible and visible through a transparent wrapper 802. The shrinking of the wrapper 802 in the illustrated embodiment forms orifices 804 that may expose portions of the band 702. In the illustrated embodiment, although a single orifice 804 is shown, another orifice 804 has been formed on the opposing side of the arrangement (not shown in the FIG. 8A). The orifice 804 may aid in allowing heat to dissipate from the heating process (that shrinks the wrapper 802). The dissipation of the heat via the orifice 804 reduces the possibility of undesirably deforming the band 702 while shrinking the wrapper 802. The illustrated embodiment includes a line of perforations 801 that may be formed to assist a user in manually removing the wrapper 802 without using a cutting tool, for example. In the illustrated embodiment, the line of perforations 801 intersects the orifice 804. In alternate embodiments, however, the line of perforations 801 may be arranged in any suitable manner.

The wrapper 802 may be formed from a material having desirable friction properties to, for example, increase the ease in handing a packaged product. In this regard, the wrapped product may be handled in a variety of automated or semi-automated systems such as conveyer belts, shoots, and rollers. A plurality of packaged products may be grouped together and moved using gripping type lift devices. It is desirable for the wrapper 802 to have a surface with a coefficient of friction that meets design parameters, for example, to allow motive rollers to propel a package or a lift device to grip multiple packages with less slippage between packages than a wrapper 802 having a lower coefficient of friction.

Figure 8B:
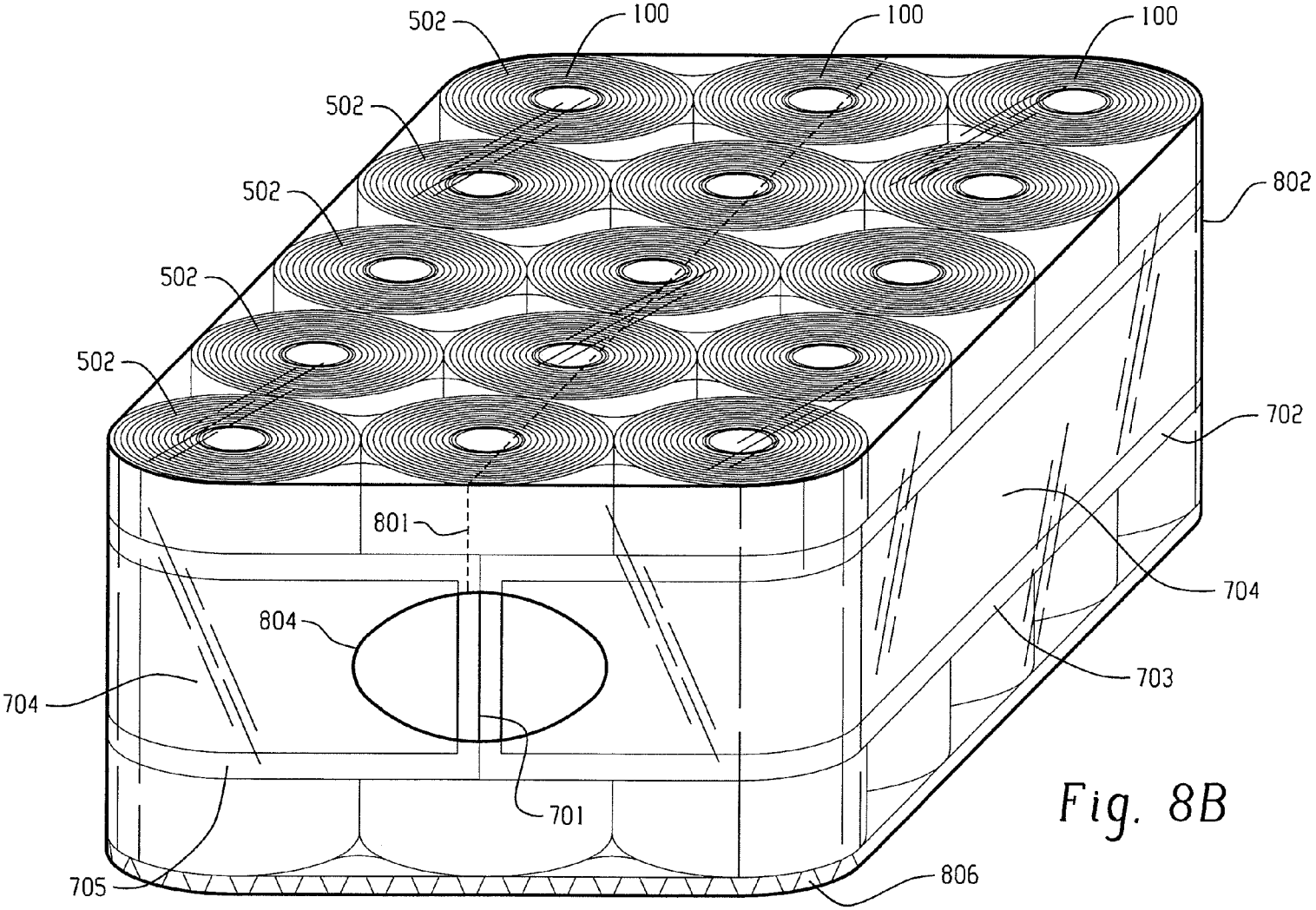
FIG. 8B illustrates an alternate exemplary embodiment of the arrangement of the rolls shown in FIG. 7 that has been wrapped in a wrapper.

FIG. 8B illustrates an alternate exemplary embodiment of an arrangement of rolls 100. In this regard, the rolls 100 are arranged and secured by the band 702. The banded rolls 100 are disposed on a rigid or semi-rigid sheet or pad 806 that may include, for example, a corrugated material. The wrapper 802 is formed around the rolls 100, the band 702, and the pad 806 in a similar manner as discussed above. The pad 806 or a similar arrangement may be included in any of the discussed embodiments.

Figure 9:
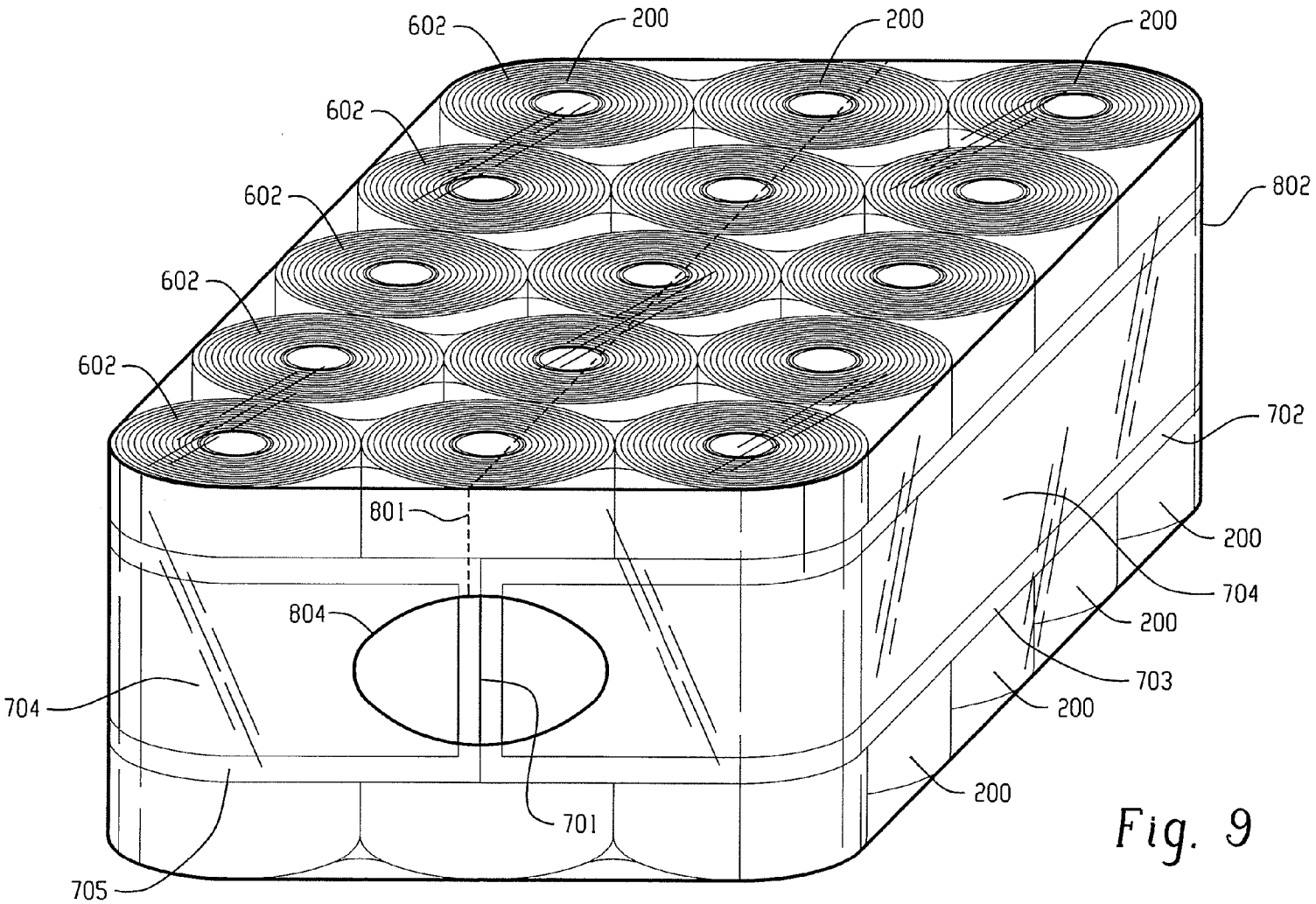
FIG. 9 illustrates an alternate arrangement of rolls.

FIG. 9 illustrates an arrangement of rolls 200 that is similar to the arrangement of rolls illustrated in FIG. 8A. In this regard, the rolls 200 are stacked on-end, grouped and wrapped in a wrapper 602, as shown in FIG. 6. The rolls 200 are grouped as illustrated, secured by a band 702, and wrapped in a wrapper 802.

Figure 10:
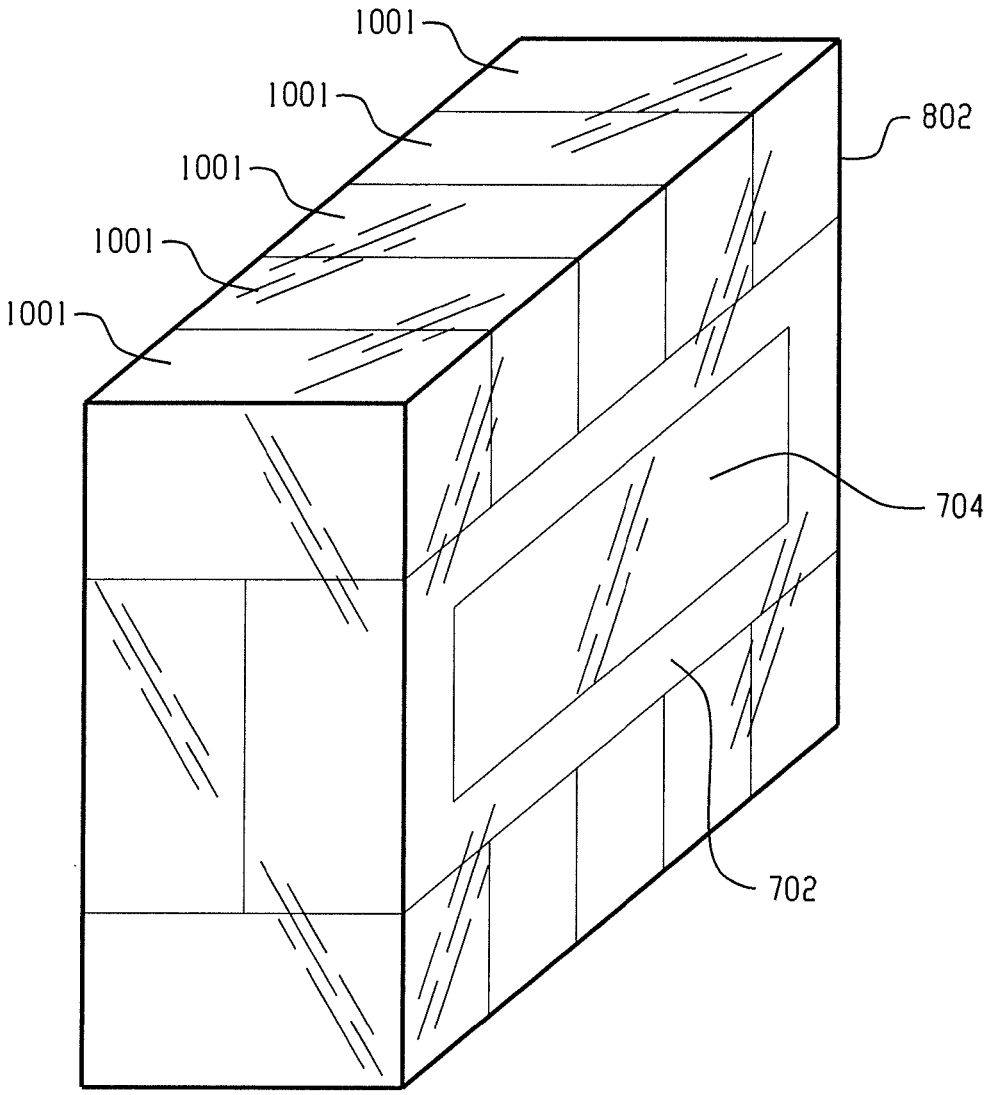
FIG. 10 illustrates an alternate exemplary embodiment of an arrangement of products.

FIG. 10 illustrates an exemplary embodiment of an arrangement of products 1001 that are rectangular prism-shaped and secured by a band 702, and wrapped in a wrapper 802 in a similar manner as described above. Though the illustrated embodiments include cylindrical and rectangular prism-shaped products, the methods and embodiments described above may be used for products having any variety of shapes. In an embodiment, each product 1001 is a stack of paper napkins oriented such that the band 702 wraps around outer surfaces of the arrangement of products 1001 to securely hold the arrangement.

Figure 11A:
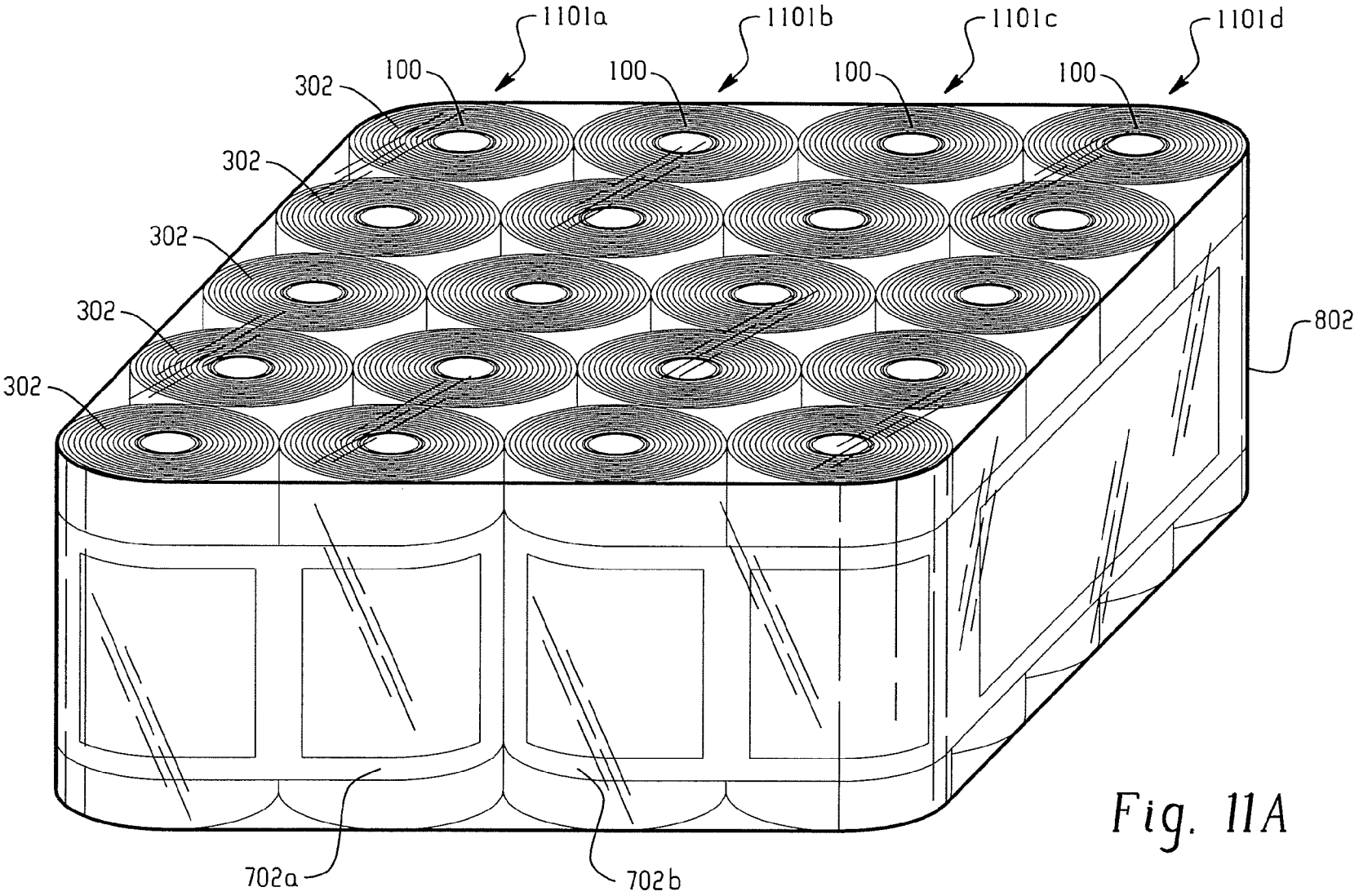
FIG. 11A illustrates an alternate exemplary embodiment of an arrangement of rolls.

FIG. 11A illustrates an exemplary embodiment of an arrangement of rolls 100 that are individually wrapped in a protective cover 302, as described above in FIG. 3. The rolls 100 are arranged in rows 1101*a*-1101*d*. The rows 1101*a* and 1101*b* are secured by a band 702*a* and the rows 1101*c* and 1101*d* are secured by a band 702*b*. The banded products are arranged adjacent to each other and wrapped in a wrapper 802 in a similar manner as described above.

Figure 11B:
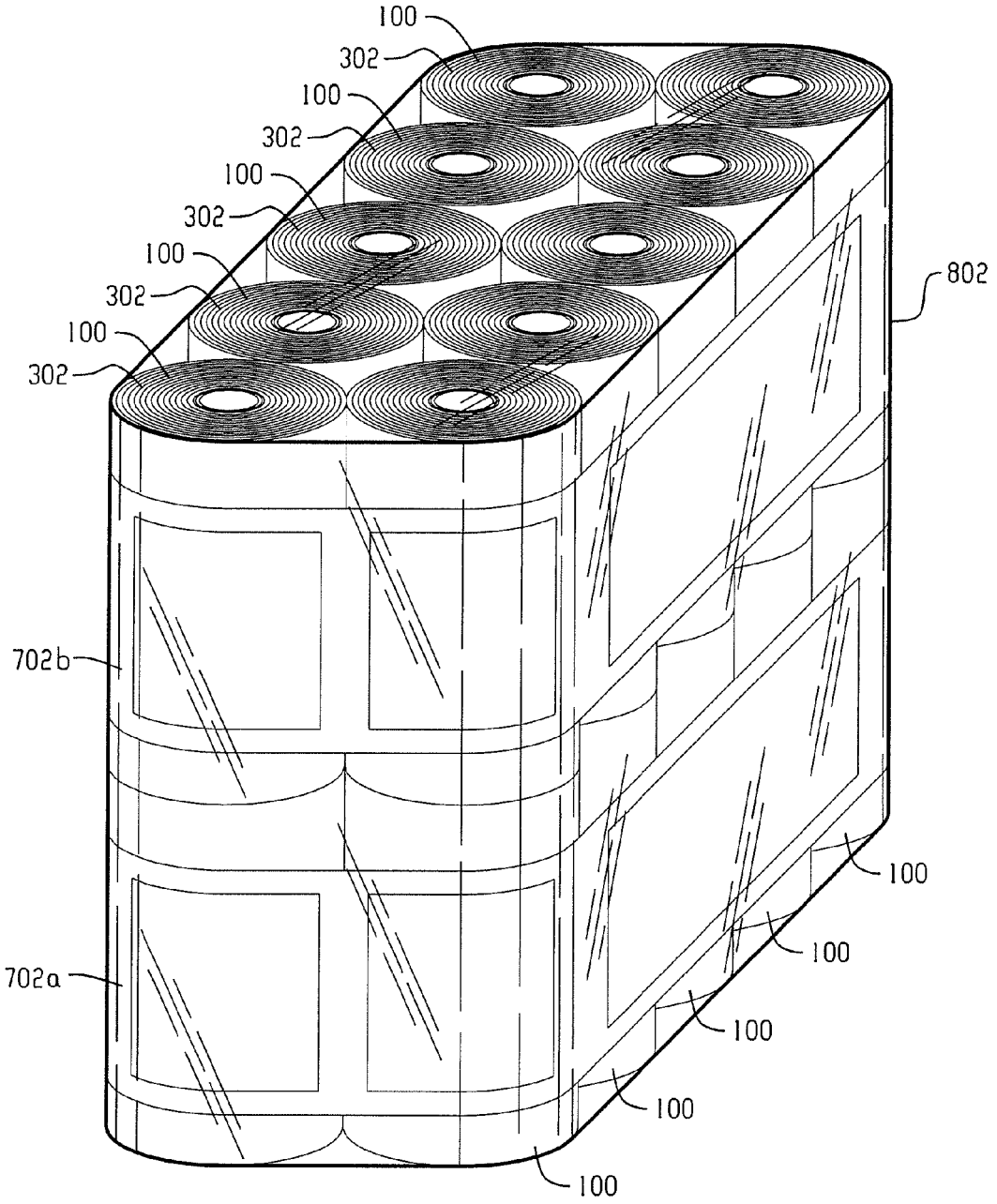
FIG. 11B illustrates another exemplary embodiment of an arrangement of rolls.

FIG. 11B illustrates an exemplary embodiment of an arrangement of rolls 100 that are individually wrapped in a protective cover 302, as described above with respect to FIG. 3. The rolls 100 are arranged in rows and secured by bands 702*a* and 702*b* in a similar manner as discussed above with respect to FIG. 11A. The rows secured by the band 702*b* are stacked onto the rows secured by the band 702*a*. The stacked rolls are wrapped in a wrapper 802 in a similar manner as described above.

Figure 12:
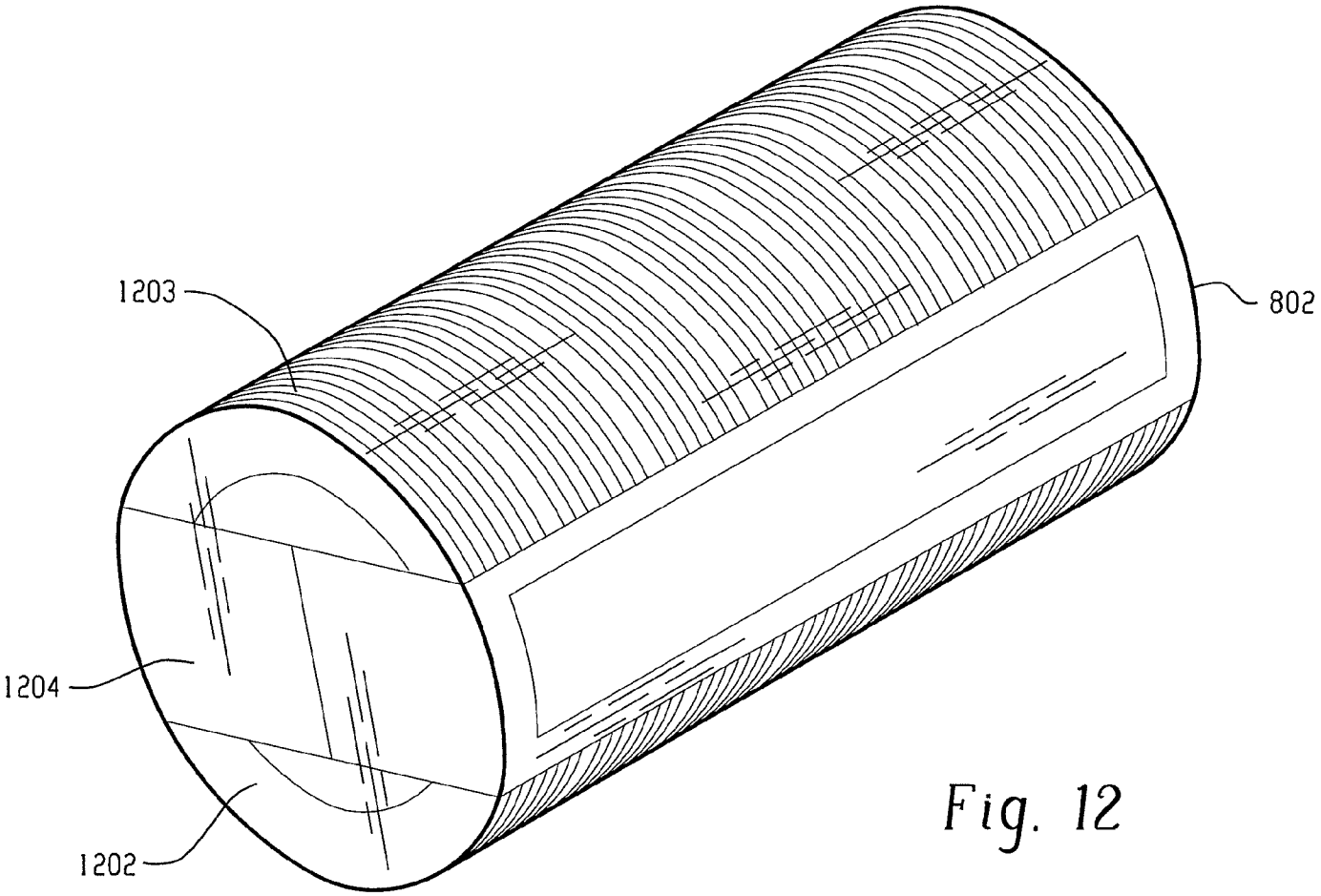
FIG. 12 illustrates an exemplary embodiment of an arrangement of plate products.

FIG. 12 illustrates an exemplary embodiment of an arrangement of tableware products 1202. The tableware products 1202 may include, for example, paper, plastic, foam, or alternate material formed in the shape of a plate, a bowl, a platter, a tray, or other type of tableware. The tableware products 1202 are packaged in groups that are wrapped in protective covers 1203. A band 1204 that is similar to the band 702 (of FIG. 7) secures the arrangement of the tableware products 1202. The arrangement of tableware products 1202, and the band 1204, are wrapped in a wrapper 802 in a similar manner as described above.

Figure 13:
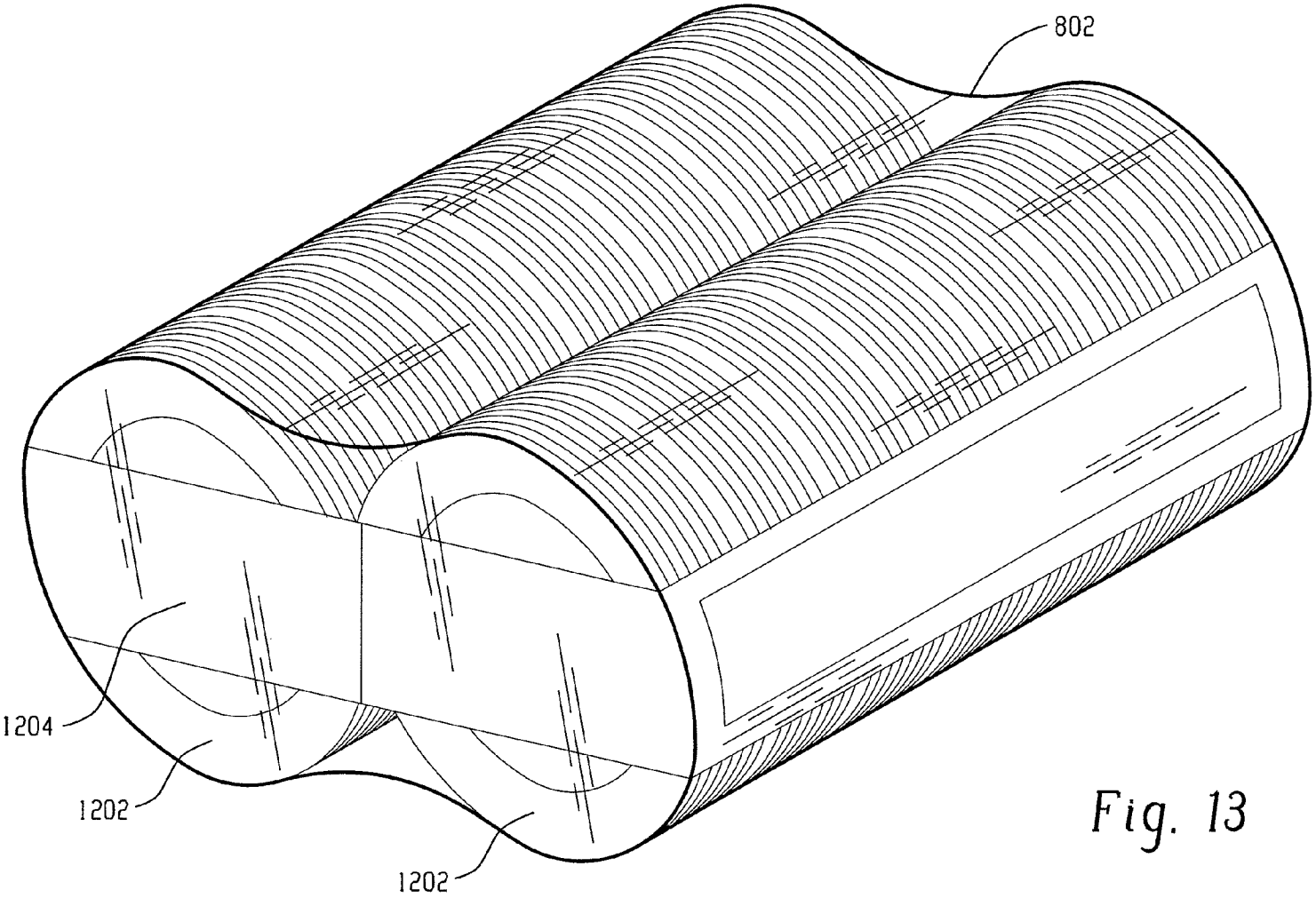
FIG. 13 illustrates another exemplary embodiment of an arrangement of plate products.

FIG. 13 illustrates another exemplary embodiment of an arrangement of tableware products 1202. The tableware products 1202 are arranged in two rows. The band 1204 secures the arrangement of the tableware products 1202. The arrangement of tableware products 1202 and the band 1204 are wrapped in a wrapper 802 in a similar manner as described above.

FIG. 13 illustrates an exemplary embodiment of an arrangement of tableware products 1202. The tableware products 1202 are arranged in two rows. The band 1204 secures the arrangement of the tableware products 1202. The arrangement of tableware products 1202 and the band 1204 are wrapper 802 in a similar manner as described above.

Figure 14:
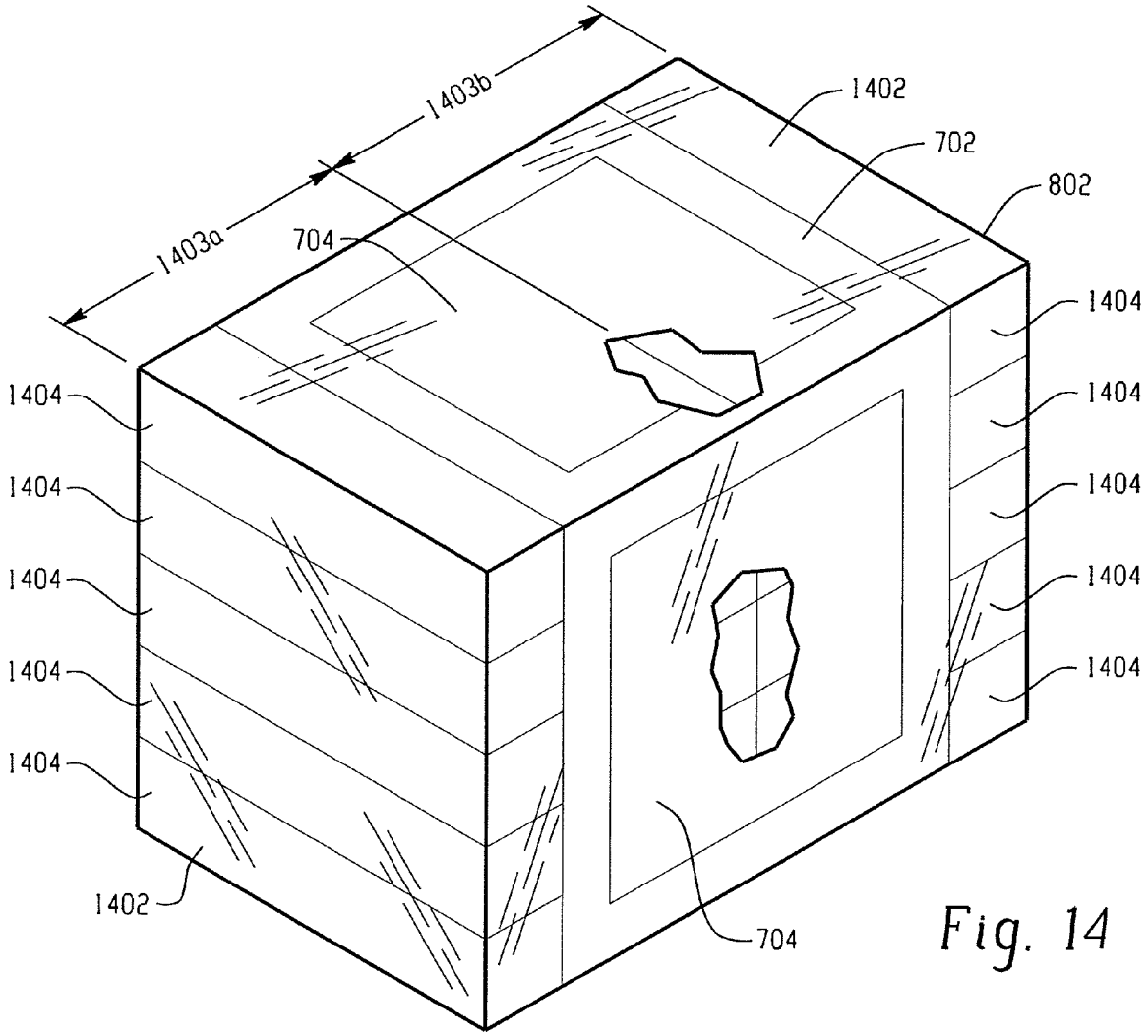
FIG. 14 illustrates another exemplary embodiment of an arrangement of sheet products.

FIG. 14 illustrates an exemplary embodiment of an arrangement of sheet products that may include, for example, stacked sheets of paper packaged in a paper or plastic protective cover 1402, resulting in a rectangularly prism-shaped product package 1404. The packages 1404 are arranged in two slacks 1403*a* and 1403*b* that are secured by a band 702 and wrapped in a wrapper 802 in a similar manner as described above.

Figure 15:
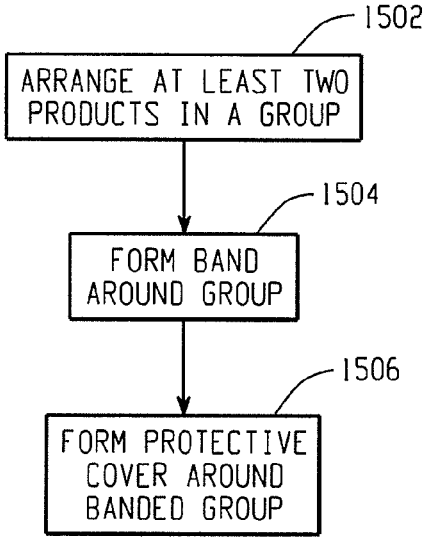
FIG. 15 illustrates a block diagram of an exemplary method of packaging products.

FIG. 15 illustrates a block diagram of an exemplary method of packaging products such as, for example, rolls of sheet products similar to the rolls 100 and 200 described above. In this regard, in block 1502, at least two products are arranged in a group. A band similar to the band 702 (of FIG. 7) is formed around the group in block 1504. In block 1506, a wrapper similar to the wrapper 802 (of FIG. 8A) is formed around the banded group. The formation of the protective cover may Include, for example, applying heat to the protective cover to reduce the surface area of the protective cover (i.e., shrink the protective cover via a shrink-wrap process) and forming a line of perforations similar to the line 801 (of FIG. 8A).

Figure 16:
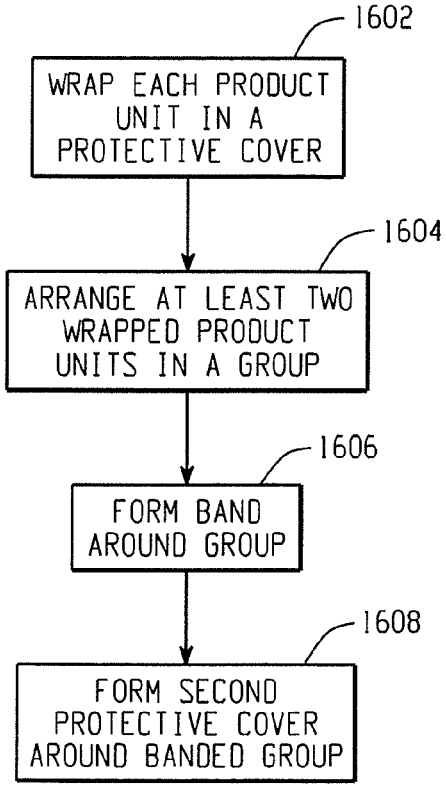
FIG. 16 illustrates a block diagram of an alternate exemplary method of packaging products.

FIG. 16 illustrates a block diagram of an alternate exemplary method of packaging products such as, for example, rolls of sheet products similar to the rolls 100 and 200 described above. In this regard, in block 1602, each product unit is wrapped in a protective cover. A product unit may include one or more products such as, for example, an individual roll 100 (of FIG. 3) that is wrapped in the protective cover 302, or an arrangement of rolls similar to the arrangement of FIG. 5, with a plurality of rolls 100 wrapped in a protective cover 502. In block 1604, at least two wrapped product units are arranged in a group. A band similar to the band 702 (of FIG. 7) is formed around the group in block 1606. In block 1608, a second protective cover (similar to the wrapper 802 of FIG. 8A) is formed around the banded group. The formation of the second protective cover may include, for example, applying heat to the second protective cover to reduce the surface area of the second protective cover (i.e., shrink the second protective cover) and forming a line of perforations similar to the line 801 (of FIG. 8A).

Though the embodiments described above include a variety of packaged products, a variety of other products may be packaged in similar manners as described above. For example, canned food stuffs or other types of products having different shapes or characteristics may be packaged as described above.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method of packaging product units, the method consisting essentially of:

(A) wrapping at least a first product unit in a cover, the first product unit comprising a rolled sheet product havinig a cylindrical core, such that the cover completely envelops the at least a first product unit and creates at least a first entirely wrapped first product unit;

(B) wrapping at least a second product unit in a cover, the second product unit comprising a rolled sheet product havinu a cylindrical core, such that the cover completely envelops the at least a second product unit and creates at least a second entirely wrapped second product unit;

(C) arranging the at least a first wrapped first product unit adjacent to the at least a second wrapped second product unit to create a product arrangement;

(D) securing the product arrangement with a singular band circumferentially around the at least a first wrapped first product unit and the at least a second wrapped second product unit to create a secured product arrangement, the singular band (i) having a width that is less than a height of either the at least a first product unit or the at least a second product unit, along an entire length of the singular band, and (ii) being printed with at least one graphic;

(E) wrapping the secured product arrangement in a wrapper to create a wrapped secured product arrangement, such that the wrapper (i) completely envelops the product arrangement and the singular band of the secured product arrangement, (ii) directly contacts the singular band, and (iii) is one of transparent and translucent; and (F) heating the wrapper to shrink the wrapper around the secured product arrangement, such that the at least one graphic on the singular band remains visible and legible through the wrapper.

wherein (i) the wrapped secured product arrangement consists essentially of the at least a first wrapped first product unit, the at least a second wrapped second product unit, the singular band, and the wrapper, and (ii) the cover of the at least a first product unit, the cover of the at least a second product unit, the singular band, and the wrapper each comprises a plastic material.

2. The method of claim 1, wherein the cover for each of the at least a first product unit and the at least a second product unit is a protective wrapper.

3. The method of claim 1, wherein the band is a plastic material having elastic properties.

4. The method of claim 1, wherein the band exerts a compressive force on the product arrangement to secure the product arrangement.

5. The method of claim 1, wherein the band is one of at least (i) partially transparent, (ii) partially translucent, and (iii) partially opaque.

6. The method of claim 1, wherein the at least one graphic on the singular band comprises at least one of (i) graphic markings and (ii) textual markings.

7. The method of claim 1, wherein the band is formed from one of (i) a single strip of material and (ii) a plurality of strips of material.

8. The method of claim 1, further comprising joining ends of the band together.

9. The method of claim 8, wherein the ends of the band are joined by one of (i) welding and (ii) plastic heating.

10. The method of claim 8, wherein the band is not appreciably deformed when the ends are joined.

11. The method of claim 8, wherein the at least one graphic on the singular band comprises at least one of (i) graphical markings, (ii) textual markings, and (iii) opaque regions, and the at least one of the graphical markings, textual markings, and opaque regions is not deformed when the ends arejoined.

12. The method of claim 1, wherein the wrapper contains at least one of (i) graphic markings and (ii) textual markings.

13. The method of claim 1, wherein the wrapper contains an orifice.

14. The method of claim 1, wherein the wrapper is a tubular shaped plastic material.

15. The method of claim 1, further comprising arranging the rolled sheet product in-line in each product unit.

16. The melhod of claim 1, further comprising stacking the rolled sheet product on-end in each product unit.

17. The method of claim 16, further comprising arranging the stacked, rolled sheet product in-line in each product unit.

18. The method of claim 1, wherein the cover of the at least a first product unit and the cover of the at least a second product unit are each at least (i) partially transparent, (ii) partially translucent, and (iii) partially opaque.

19. The method of claim 1, wherein the cover of the at least a first product unit and the cover of the at least a second product unit each contain at least one of (i) graphic markings and (ii) textual markings.

20. A package of product units, the package consisting essentially of:

(A) at least a first entirely wrapped first product unit including at least a first product unit comprising a rolled sheet product having a cylindrical core completely enveloped in a cover;

(B) at least a second entirely wrapped second product unit (i) including at least a second product unit comprising a rolled sheet product having a cylindrical core completely enveloped in a cover and (ii) being disposed adjacent to the at least a first wrapped first product unit;

(C) a singular band disposed circumferentially around the at least a first wrapped first product unit and the at least a second wrapped second product unit to create a secured product arrangement, the singular band (i) having a width that is less than a height of either the at least a first product unit or the at least a second product unit, along an entire length of the singular band, and (ii) being printed with at least one graphic; and (D) a shrinkable wrapper completely enveloping the singular band, the at least a first wrapped first product unit, and the at least a second wrapped second product unit of the secured product arrangement to create a wrapped secured product arrangement, such that the wrapper (a) is heated to shrink the wrapper around the secured product arrangement, with the at least one graphic on the singular band remaining visible and legible through the wrapper upon shrinking, (b) directly contacts the singular band, and (c) is one of transparent and translucent, wherein (i) the wrapped seemed product arrangement consists essentially of the at least a first wrapped first product unit, the at least a second wrapped second product unit, the singular band, and the shrinkable wrapper, and (ii) the cover of the at least a first product unit, the cover of the at least a second product unit, the singular band, and the shrinkable wrapper each comprises a plastic material.

21. The package of claim 20, wherein the cover for each of the at least a first product unit and the at least a second product unit is a protective wrapper.

22. The package of claim 20, wherein the band is a plastic material having elastic properties.

23. The package of claim 20, wherein the band exerts a compressive force on the product arrangement to secure the product arrangement.

24. The package of claim 20. wherein the band is one of at least (i) partially transparent, (ii) partially translucent, and (iii) partially opaque.

25. The package of claim 20, wherein the at least one graphic on the singular band comprises at least one of (i) graphic markings and (ii) textual markings.

26. The package of claim 20, wherein the band is formed from one of (i) a single strip of material and (ii) a plurality of strips of material.

27. The package of claim 20, wherein ends of the band are joined by one of (i) welding and (ii) plastic heating.

28. The package of claim 26, wherein the band is not appreciably deformed when the ends are joined.

29. The package of claim 20, wherein the at least one graphic on the singular band comprises at least one of (i) graphical markings, (ii) textual markings, and (iii) opaque regions, and the at least one of the graphical markings, textual markings, and opaque regions is not deformed when ends of the band are joined.

30. The package of claim 20, wherein the wrapper contains at least one of (i) graphic markings and (ii) textual markings.

31. The package of claim 20, wherein the wrapper contains an orifice.

32. The package of claim 20, wherein the wrapper is a tubular shaped plastic material.

33. The package of claim 20, wherein the rolled sheet product is arranged in-line in each product unit.

34. The package of claim 20, wherein the rolled sheet product is stacked on-end in each product unit.

35. The package of claim 34, wherein the stacked, rolled sheet product is arranged in-line in each product unit.

36. The package of claim 20, wherein the cover of the at least a first product unit and the cover of the at least a second product unit are each at least (i) partially transparent, (ii) partially translucent, and (iii) partially opaque.

37. The package of claim 20, wherein the cover of the at least a first product unit and the cover of the at least a second product unit each contain at least one of (i) graphic markings and (ii) textual markings.

* * * * *